US007798743B2

(12) United States Patent
Blackmon et al.

(10) Patent No.: US 7,798,743 B2
(45) Date of Patent: Sep. 21, 2010

(54) COMPOSITION AND METHOD OF USE OF SOY-BASED BINDER MATERIAL

(75) Inventors: Donald Blackmon, Milwaukie, OR (US); Swayne Walther, Idaho City, ID (US)

(73) Assignee: Enviroad, LLC, Portland, OR (US)

( * ) Notice: Subject to any disclaimer, the term of this patent is extended or adjusted under 35 U.S.C. 154(b) by 142 days.

(21) Appl. No.: 12/256,287

(22) Filed: Oct. 22, 2008

(65) Prior Publication Data

US 2009/0103979 A1 Apr. 23, 2009

Related U.S. Application Data

(60) Provisional application No. 60/999,947, filed on Oct. 22, 2007.

(51) Int. Cl.
*E01C 7/24* (2006.01)
*E01C 7/36* (2006.01)
*E01C 21/00* (2006.01)

(52) U.S. Cl. ..... 404/75; 404/76; 404/27

(58) Field of Classification Search ..... 404/75, 404/76, 27; 405/258.1; 252/88.1
See application file for complete search history.

(56) References Cited

U.S. PATENT DOCUMENTS 4,001,033 A * 1/1977 Anthone et al. ..... 106/287.23
4,571,116 A * 2/1986 Patil et al. ..... 404/76
4,737,305 A * 4/1988 Dohner ..... 252/88.1
4,801,635 A 1/1989 Zinkan et al.
5,084,207 A * 1/1992 Reed et al. ..... 252/88.1
5,412,007 A 5/1995 Hendrix et al.
5,824,725 A * 10/1998 Lahalih ..... 405/264
2009/0169867 A1* 7/2009 Kelly ..... 428/326

FOREIGN PATENT DOCUMENTS

WO WO2005/121272 A1 * 12/2005

* cited by examiner

*Primary Examiner*—Raymond W Addie
(74) *Attorney, Agent, or Firm*—Alleman Hall McCoy Russell & Tuttle LLP

(57) ABSTRACT

A composition and method for use of a soy-based material binder is provided. One example method for increasing road stabilization with a soy-based material binder may include determining road base attributes of the road base for application. The method may further include creating a soy-based material binder comprising at least one of a soy protein isolate with a concentration in the range of 1 to 20% of soy protein isolate based on road base attributes. The method may further include determining an amount of soy-based material binder for a volume of application based on the concentration of soy protein isolate in the soy-based material binder and the road base attributes. Further still, the method may include combining the soy-based material binder and the road base wherein the resultant mixture includes soy-based material binder in a range of 0.0001-5 gallons per pound of road base.

20 Claims, 7 Drawing Sheets

COMPOSITION AND METHOD OF USE OF SOY-BASED BINDER MATERIAL

CROSS-REFERENCE TO RELATED APPLICATIONS

This application claims priority from U.S. Provisional Patent Application No. 60/999,947 of Donald Blackmon and Swayne Walther, entitled "COMPOSITION AND METHODS FOR MATERIAL BINDER" filed Oct. 22, 2007, the disclosure of which is hereby incorporated by reference in its entirety and for all purposes.

FIELD OF THE INVENTION

The present disclosure relates to a soy-based material binder. More particularly, the disclosure is directed to a soy-based stabilizer for soil stabilization and dust suppression.

BACKGROUND

As an example, dirt and aggregate road surfaces may be adversely affected by weather and time. Specifically, exposure to various extreme weather conditions, such as temperature changes, precipitation, etc. may affect the quality of a dirt and aggregate road surface. Further, exposure to traffic may cause accelerated degradation of road surfaces. For example, improperly stabilized road surfaces may be subject to the formation of potholes, wash-boarding, frost-boils, dry weather flaking, wet weather leaching, erosion, as some examples. Moreover, use of such dirt and aggregate roads may result in loss of road bed material and high levels of dust being created.

Various compositions and products have been used on road surfaces in an attempt to minimize the effect of use and weather on such road surfaces and improve the durability and quality of the road surfaces.

Examples of dust suppressants and soil stabilizers are disclosed in U.S. Pat. Nos. 4,001,033; 4,571,116; 4,737,305; 4,801,635; 5,084,207; 5,412,007; and 5,824,725, the disclosures of which are incorporated by reference in their entirety for all purposes.

However, many of these products provide only short-term relief from the above-described conditions. Additionally, some of the products require frequent reapplication due to the loss of product on the road from traffic and/or weather conditions. For example, rainy weather may result in erosion of the products. Moreover, a wet winter may result in the leaching of the products, and products can thereby introduce contaminants into the local environment. Other issues in regards to current products include the stability and cost of the products. In some instances, the products may become unstable during storage and require remixing or other conditioning. Further, many of the known products become unstable over time. Another issue is a higher cost of the product. Further, there is waste of non-food grade soy product in the soy industry.

SUMMARY

A soy-based material binder may be an effective use of non-food grade soy product. The use of non-food grade soy product in a soy-based material binder may substantially reduce the costs of stabilizing roadways and may have minimal environmental effect.

The present application is directed towards a soy-based material binder which may be used as a dust suppressant and soil stabilizer. A composition and methods for a soy-based material binder are provided to address the above issues. The inventors herein have recognized a method for increasing road stabilization with a soy-based material binder. The method may include creating a soy-based material binder including at least one of a soy protein isolate with a concentration in the range of 1 to 20% of soy protein isolate by weight. The method may further include adjusting the concentration of the soy protein isolate in the soy-based material binder based on road base attributes. Further still, the method may include determining the amount of soy-based material binder for a volume of application based on the concentration of soy protein isolate in the soy-based material binder and based on the road base attributes. Further still, the method may include applying the soy-based material binder to the road base.

The soy-based material binder may be selectively applied to a road base to improve hardness of a surface and/or suppress dust particles. For example, the soy-based material binder may aggregate fine particles such that the particles are retained along a surface, such as a roadbed. These binding and dust suppression characteristics may withstand environmental changes, including wind, snow, rain, heat, sunlight, etc. making the soy-based material binder a durable alternative to current stabilizers and dust suppressants.

In some embodiments, the binder may be used in other environments including hydroseeding, flowable fill, concrete additive, wood pelletization and/or feed pellet pelletization. The advantages of the present invention will be understood more readily after a consideration of the Detailed Description.

DETAILED DESCRIPTION OF THE DRAWINGS

Figure 1:
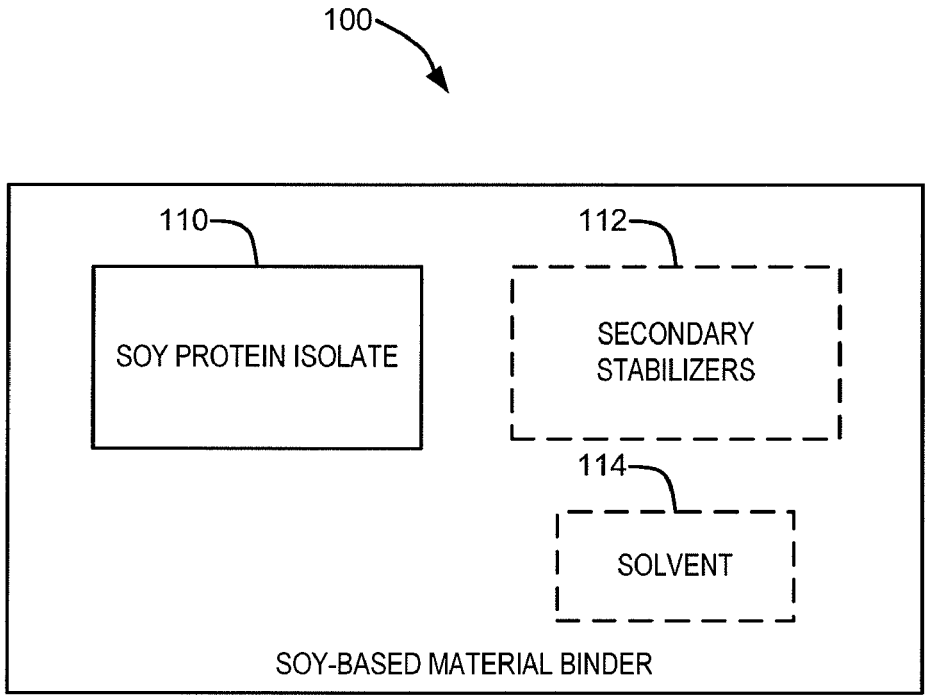
FIG. 1 shows a schematic drawing depicting components for a soy-based material binder.

As described herein, a soy-based material binder may be produced using a soy base, such as a soy protein isolate or variant thereof derived from non-food grade soy product, in one example. The use of non-food grade soy product in a soy-based material binder may substantially reduce the costs of stabilizing roadways and may have minimal environmental effect.

Systems and methods for increasing road stabilization with a soy-based material binder are therefore described herein. In one example method, a soy-based material binder is generated. The desired concentration of the soy protein isolate (SPI) in the soy-based material binder may be determined by determining and/or assessing the road base attributes of the road base for application. For example, some attributes that may affect concentration of SPI in the soy-based material binder include chemical composition, hardness, and strength (e.g., shear strength). For example, when shear strength of a road base is less than a predetermined threshold, a higher concentration of SPI may be used in the soy-based material binder. The concentration of the SPI in the soy-based material binder may be adjusted based on road base attributes by being mixed into a solution, in one example. In other embodiments, the disclosed soy-based material binder may be applied in a solid form. Further, the amount of soy-based material binder for a volume of application may be determined based on the SPI concentration and road base attributes.

In one specific example described in detail herein, the soy-based material binder may be applied to a road base. In another example, the soy-based material binder may be used to prevent erosion of banks or fields. The soy-based material binder may operate to bind the aggregate particles and retain them in a form which creates a substantially durable hard surface, suppress dust particles and/or limit erosion, as some examples. These binding and dust suppression characteristics may withstand environmental changes, including wind, snow, rain, heat, and sunlight, as some examples, thus making the soy-based material binder a durable alternative to current stabilizers and dust suppressants. By mixing the soy-based binder into the road base, it may be possible to cost-effectively stabilize and improve the durability and life expectancy of the road. The mixture may provide a "concrete-like" or "paved-type" surface.

In contrast to prior stabilizers and dust suppressants, the soy-based material binder may reduce costs of the product to approximately as an eighth or a tenth of the cost for prior products. For example, known systems may use stabilizers which cost 70 cents per square yard, while use of the soy-based material binder may reduce the cost to 5 to 10 cents per square yard. In addition to the significant reduction in costs, the soy-based material may have high levels of binding capabilities and hardening capabilities.

The soy-based material binder may be configured to be applied to dirt and aggregate roadbeds and other similar surfaces. Although described primarily in regard to use as a soil stabilizer and/or dust suppressant in the present application, it should be appreciated that the soy-based material binder disclosed herein may be used as soil, road aggregate, coal ash aggregate, animal feed, wood chip/sawdust binder that may be used for fugitive dust control, road base and in-depth stabilization, erosion control, hydroseeding, flowable fill, concrete additive, wood pelletization and/or feed pellet pelletization.

Example methods to create and use the soy-based material binder and the composition of the soy-based material binder are provided below. It should be appreciated that such examples are provided for illustration and the invention is not so limited. References to weight percentages and mixtures are only examples and the examples are provided for illustrative purposes.

As illustrated in FIG. 1, the soy-based material binder 100 may include a soy protein isolate (SPI) 110. It may be appreciated that the SPI herein described may include any protein isolate and/or variants thereof including soy protein concentrate, defatted soy, full fat soy flour, low fat soy flour, high fat soy flour, lecithated soy flour, rapeseed protein isolate and fava bean protein concentrate, and may be used alone or in a modified form as a soil stabilizer, in some examples. Further, such protein isolates and variants thereof may be combined with one or more of a secondary stabilizer 112, including a coal combustion product (e.g., fly ash, bottom ash), resin, lignin, and surfactant and used as an improved soil stabilizer. Further still, such protein isolates and variants thereof may be combined with a lignin including one or more of calcium, sodium and/or ammonium lignosulfonates and used as an improved soil stabilizer. Likewise, in other embodiments, protein isolates and variants thereof, may be combined with one or more of a calcium, magnesium and/or sodium chloride (or a combination thereof) and used as an improved soy-based material binder. The soy-based material binder may be combined with a solvent 114, such as water, in some embodiments, in the range of 1-20% of the soy-based material binder by weight.

The soy-based material binder in the following examples may be combined with one or more of a road surface aggregate to form a road base. The soy-based material binder may be included in the road base in the range of 0.0001-5 gallons per pound of road base in some examples.

In a first example, SPI alone, may be modified by heating and/or denaturing by acid or alkali pH modification, such as by use of cationic, non-ionic, or anionic surfactants or detergents, and/or the addition of an amino containing compound. Further, in some embodiments, the soy protein isolate, or modified soy protein isolate, may be used as an additive to: calcium, sodium, and/or ammonium lignosulfonates or calcium, magnesium, and/or sodium chloride (or a combination of) and used as described above.

In another example, soy protein concentrate alone, may be modified by heating and/or denaturing by acid or alkali pH modification, such as by use of cationic, non-ionic, or anionic surfactants, and/or the addition of an amino containing compound. Further, in some embodiments, the soy protein concentrate, or modified soy protein concentrate, may be used as an additive to: calcium, sodium, and/or ammonium lignosulfonates or calcium, magnesium, and/or sodium chloride (or a combination of) and used as described above.

Likewise, in another example, defatted soy (such as flakes, meal, and flour), or modified defatted soy, such as through modification by heating and/or denaturing by acid or alkali pH modification, such as by use of cationic, non-ionic, or anionic surfactants, and/or the addition of an amino containing compound, may be used. Further, in some embodiments, the defatted soy or modified defatted soy may be used as an additive to: calcium, sodium, and/or ammonium lignosulfonates or calcium, magnesium, and/or sodium chloride (or a combination of) and used as described above.

In yet additional examples, full fat soy flour soy, low fat soy flour, or high fat soy flour and/or modified full fat soy flour soy, modified low fat soy flower, or modified high fat soy flour, such as through modification by heating and/or denaturing by acid or alkali pH modification, such as by use of cationic, non-ionic, or anionic surfactants, and/or the addition of an amino containing compound, may be used alone or in combination. Further, in some embodiments, the full fat soy flour soy, low fat soy flour, or high fat soy flour and/or modified full fat soy flour soy, modified low fat soy flower, or modified high fat soy flour, may be used as an additive to: calcium, sodium, and/or ammonium lignosulfonates or calcium, magnesium, and/or sodium chloride (or a combination of) and used as described above.

In another example, lecithinated soy flour or modified lecithinated soy flour, such as through modification by heating and/or denaturing by acid or alkali pH modification, such as by use of cationic, non-ionic, or anionic surfactants, and/or the addition of an amino containing compound, may be used. Further, in some embodiments, lecithinated soy flour or modified lecithinated soy flour may be used as an additive to: calcium, sodium, and/or ammonium lignosulfonates or calcium, magnesium, and/or sodium chloride (or a combination of) and used as described above.

As another example, rapeseed protein isolate or modified rapeseed protein isolate, such as through modification by heating and/or denaturing by acid or alkali pH modification, such as by use of cationic, non-ionic, or anionic surfactants, and/or the addition of an amino containing compound, may be used. Further, in some embodiments, rapeseed protein isolate or modified rapeseed protein isolate may be used as an additive to: calcium, sodium, and/or ammonium lignosulfonates or calcium, magnesium, and/or sodium chloride (or a combination of) and used as described above.

In yet another example, fava bean protein concentrate or modified fava bean protein concentrate, such as through modification by heating and/or denaturing by acid or alkali pH modification, such as by use of cationic, non-ionic, or anionic surfactants, and/or the addition of an amino containing compound, may be used. Further, in some embodiments, fava bean protein concentrate or modified fava bean protein concentrate, may be used as an additive to: calcium, sodium, and/or ammonium lignosulfonates or calcium, magnesium, and/or sodium chloride (or a combination of) and used as described above.

The soy-based material binder 100 may be comprised of a variety of components as described above. For example, the soy-based material binder may include a variety of secondary stabilizers 112 including clay, powdery fly ash, bottom ash, ammonium lignosufonates, and a resin product, as examples.

The following experimental results of soy-based material binders have been observed. Mixture A: 6.2% SPI material binder by weight produced a hard mixture. Mixture B: 20.0 g of 6.2% SPI material binder by weight mixed with 100.1 g of dry heavy clay produced a mixture which set up hard. Mixture C: 50 g 6.2% SPI material binder by weight mixed with 100 g of powdery fly ash produced a very hard mixture. Mixture D: 20 g of 6.2% SPI material binder by weight mixed with 100.1 g of sand-like bottom ash produced a very hard mixture. Mixture E: 50 g of 6.2% SPI material binder by weight mixed with 50 g 50% lignin solute (e.g., obtained by mixing 50 g ammonium lignosulfonate and 50 g water) produced a very hard mixture with darkened color.

The soy-based material binder may further be combined with a resin product. As an exemplary resin product, and not as a limitation, one product which may be mixed with the soy-based material binder is EARTHBIND® 100 manufactured by EnviRoad®. The combined binding materials may provide a high-level binder and dust suppression agent. The following experimental results have been observed. Mixture F: 0.25 gallons of concentrated EARTHBIND® 100 mixed with 1.25 gallons of H20 to obtain a 4:1 EARTHBIND® 100 solution. Then, 20.3 g of the 4:1 EARTHBIND® 100 solution was mixed with 105.9 g of sand and gravel to form a hard/very hard mixture. Mixture G: 50 g of the 4:1 EARTHBIND® 100 solution was mixed with 200 g 6.2% SPI material binder and a hard/very hard mixture with lighter color compared to Mixture F was produced.

It may be appreciated that the experimental mixtures described above are exemplary in nature and other embodiments of the soy-based material binder 100 combined with secondary stabilizers 112 including, as some examples, clay, powdery fly ash, bottom ash, lignins (e.g., ammonium lignosufonates), resin, and surfactants in different proportions may be included in the scope of the present application, for example as described in U.S. Publication No. 2006/0011105 A1 entitled "Composition and Method for Stabilizing Road Base", hereby incorporated by reference for all purposes.

As described above, ash may be combined with the soy-based material binder and used in constructing a road base. The ash may be a byproduct/waste product of burning coal, including bottom ash, boiler slag, fly ash, and mixtures of such ashes. As an example, the fly ash is typically a fine powder-like substance formed from the mineral matter in some coal, including the noncombustible matter in coal plus a small amounts of carbon that remain from incomplete combustion. In some embodiments, fly ash may comprise mostly silt-sized and clay-sized glassy spheres, with a consistency somewhat like talcum powder. Properties of fly ash may vary with coal composition and plant-operating conditions. For example, the properties of fly ash may vary on different operations within the coal plant, such as selection, carbon reduction, classification, grinding, blending and homogenization.

As described above, the mixture may also include a secondary stabilizer, such as a liquid lignin, such as lignin sulfonate. Lignin sulfonate, as used herein, is a metallic sulfonate salt made from the lignin of sulfite pulp-mill liquors. Such lignin sulfonate may be approximately 20 wt. % to 60 wt. % of the overall composition. Lignin sulfonate may act as a watering agent and as a soil stabilizer to bind to various types of soils and ash. The combination of the petroleum resin and the lignin sulfonate result in a composition that is adapted to provide effectively binding of various types of soils particles and/or ash together. Further, it may also generate a substantially waterproof surface. This binding may further function to mitigate airborne particles and prevent the soil or ash from dispersing over time from roadway use.

It should be appreciated that various types of lignin sulfonates may be used. For example, both ammonium lignin sulfonate and/or a calcium lignin sulfonate are suitable lignin sulfonates. It should be appreciated that other types of lignin sulfonates may be used, including, but not limited to sodium lignin sulfonate. The type of lignin sulfonate used may depend on the specific application of the composition. Thus, in the exemplary composition, ammonium lignin sulfonate is identified as a suitable lignin sulfonate; however it should be appreciated that for other road surfaces or conditions a different lignin sulfonate may be used. The ammonium lignin sulfonate of the exemplary composition is shown as being generally 15 wt. % to 45 wt. % of the composition.

In addition to a petroleum resin and the lignin sulfonate, the composition further may include approximately 1 wt. % to 20 wt. % of a surfactant, also referred to herein as the emulsifier. The surfactant in the composition may optionally be a non-ionic surfactant. For example, alkylphenols, such as a nonylphenol ($C_9H_{19}C_6H_4OH$), may be used as the non-ionic surfactant. The present surfactant functions as an emulsifier which is adapted to wet out various types of soil surfaces (regardless of charge). Unlike an oppositely-charged surfactant system, which is configured to wet only a specific surface type, the present emulsifier may be adapted to wet a variety of surfaces making the overall composition extremely versatile.

In an oppositely-charged surfactant system, the type of particles and/or soil may require use of a different charged emulsifier. For example, with limestone aggregates (having a positive charge on the surface), a negatively-charged emulsifier (anionic) may be used to obtain a desired level of wetting of the particles. Similarly, a granite surface (having a negative charge on the surface), may be suitable for a positively-charged emulsifier (cationic) to get the best wetting of the particles. In the present composition, the non-ionic emulsifier enables maximum wetting of the different types of particles, such as soil. Thus, the non-ionic emulsifier is adapted to wet out both cationic and anionic soils (e.g., limestone and granite, respectively) quickly and more efficiently than using an oppositely-charged surfactant system. It should be appreciated that the wetting of the soil enables the petroleum resin to come into closer contact with individual particles. The ability to come into closer contact may result in more thoroughly coated particles, creating a more weatherproof surface once compacted.

Another consideration regarding the emulsifier is the overall stability of the emulsifier. A good emulsifier for the present composition may be a stable product that is easily useable in the field. Further, the emulsifier should be easy to store and transport, such that there are no difficulties in transporting or handling the composition or its components.

It should be appreciated that the soy-based material binder, including or not including the EARTHBIND® 100 may be stored in a concentrated form and diluted prior to application. For example, the product may be used at water-to-product concentrations of 3:1 to 20:1 depending on the soil type, traffic flow, amount of ash and other environmental factors.

Several exemplary methods for increasing road stabilization with a soy-based material binder are illustrated in FIGS. 2-7. It may be appreciated that the examples disclosed include optional steps represented by dashed lines and the existence of explicitly optional steps do not negate the optionality of all steps in the methods disclosed herein.

Figure 2:
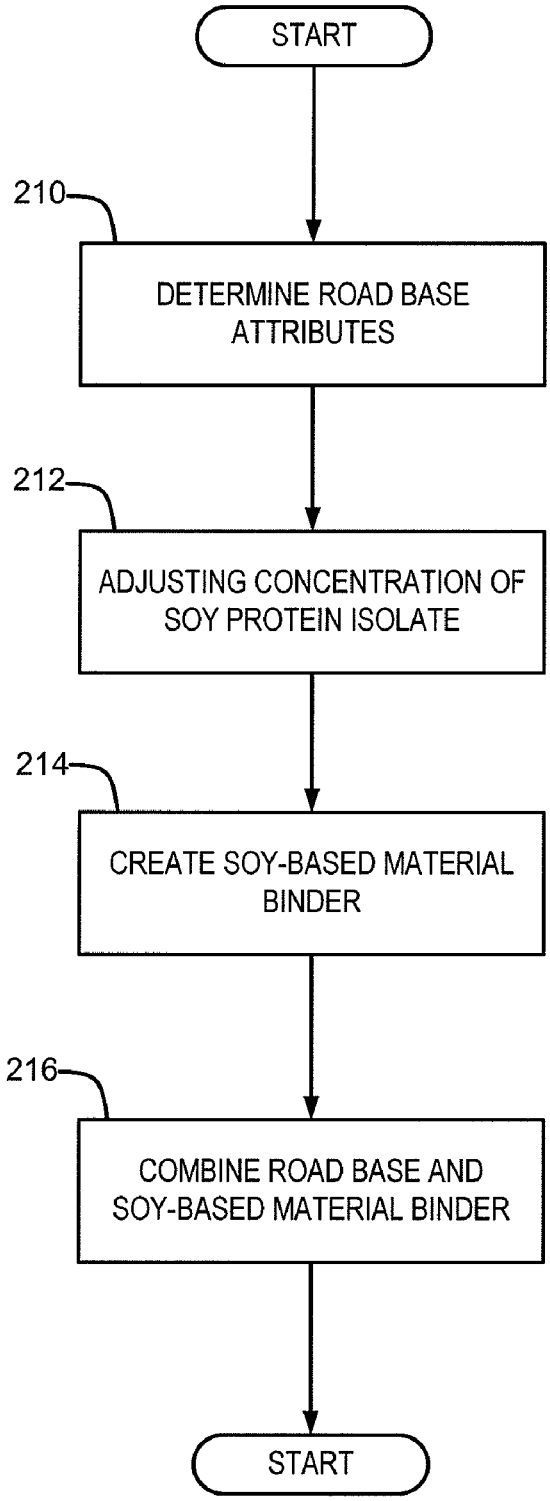
FIG. 2 shows an example method flowchart for creating a soy-based material binder.

A method for increasing road stabilization is illustrated in FIG. 2. The road base attributes are determined at 210. As described above, road base attributes may include chemical composition, hardness, shear strength, etc. The concentration of SPI in the soy-based material binder is then adjusted based on, at least, the road base attributes at 212. The soy-based material binder is created at 214 and combined with the road base at 216. The road base may include soil, sand, dirt and/or gravel.

An exemplary experimental series of the hardness and shear strength observations of soy protein isolates and variants when mixed with coarse sand, dirt and/or gravel, as described above, is provided in Chart A below. Controls are also listed in the chart below and are italicized.

In one example, 10 g of SPI is the primary ingredient and is dissolved in water such that the SPI is 6.7% by weight. There is no secondary ingredient in this example. The observations include very hard hardness, excellent shear strength, and no odor. Further, it has a high level of bonding and stabilization potential. Further still, it was observed to be close to colorless when dry. In another example, Ticagel (a gum) was the primary ingredient, used here as a hydrocolloid to help a mixture of soy stay in suspension. Each of the other examples in Chart A may be similarly understood.

CHART A

| Primary Ingredient [g] | Solvent | Weight percent | Secondary Ingredient [g] | Hardness | Shear Strength | Odor | Notes |
|---|---|---|---|---|---|---|---|
| SPI[10] | Water | 6.7 | — | Very Hard | Excellent | – | High level of bonding and stabilization potential. Close to colorless when dry. |
| Heated soy (90 C)[10] | Water | 6.7 | — | Very Hard | Excellent | – | High level of bonding and stabilization potential |
| Defatted soy[10] | Water | 6.7 | — | Hard | Poor | – | Not as durable as SPI; erosion potential |
| SPI (dry form)[10] | — | — | Lime[10.1] | Very Hard | Excellent | + | High level of bonding and stabilization potential, odor observed |
| Defatted soy (dry)[10.3] | — | — | Lime[5.0] | Very Hard | Very Good | – | Appears that mixing DFS into soil works better than in Exp. #3 when mixed in using water solution |
| Hydrated lime (control) | — | — | CaCl3[5.1] | Mod. Hard | Poor | – | The soil was very white; surface was hard but easily broken up; likely to dust up; high level of erosion potential |
| SPI[5.2] + Hyd. Lime | — | — | CaCl3[5.4] | Very Hard | Excellent | – | High level of bonding and stabilization potential; slight white color modification |
| SPI[5.2] + CaCl2 | — | — | — | Very Hard | Excellent | – | High level of bonding and stabilization potential |
| CaCl2 (control) | — | — | — | Below Mod. | Poor-Avg. | – | Works well for dust control but surface easily broken up; Poor stabilizer |

CHART A-continued

| Primary Ingredient [g] | Solvent | Weight percent | Secondary Ingredient [g] | Hardness | Shear Strength | Odor | Notes |
|---|---|---|---|---|---|---|---|
| Ticagel[0.3] | Water | 0.2 | — | Poor | Poor | – | May have slight dust binding characteristic; hydrocollode for SPI suspension |
| Soy Protein Concentrate [0.000] | Water | — | — | Hard | Poor | – | Binding potential lower; erosion potential |

Additional tests were completed to identify the effects of overnight soaking of the various soy-based material binders in bonded form. The materials remained in a bonded form after overnight soaking. In some embodiments, the soy-based material remained relatively hard. For example, the hydrated lime and soy protein isolate combination was observed to be moderately hard after a 24 hour soaking. As another example, the soy protein isolate in the dry form was observed to be less hard than the hydrated lime and soy protein isolate combination after a 24 hour soak but the materials remained in a bonded form. Similarly, the soy protein isolate and calcium chloride combination was observed to be less hard than the hydrated lime and soy protein isolate combination after a 24 hour soak but the materials remained in a bonded form. The remaining example materials, as illustrated in Chart A, remained in a bonded form after an overnight soaking and were less hard than the three above described examples.

Figure 3:
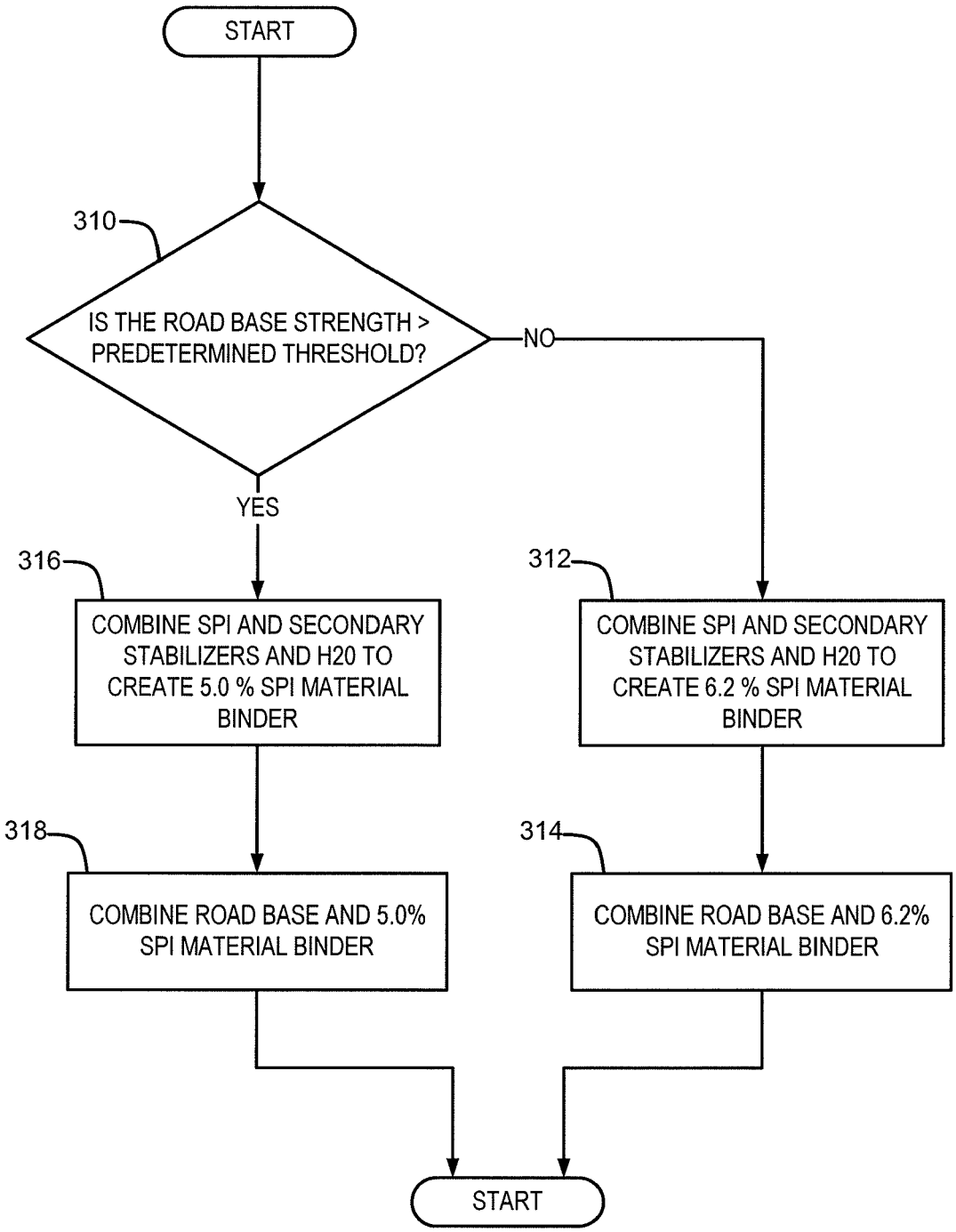
FIG. 3 shows an example method flowchart for adjusting concentration of a soy-based material binder dependent on road base composition.

Thus, it may be appreciated that the hardness and shear strength measures of the soy-based material binder may depend on the composition of the soy-based material binder. Further, it may be appreciated that said measures may be affected by, at least, road base attributes. Referring now to FIG. 3, a specific method for determining SPI concentration in the soy-based material binder based on strength (e.g., shear strength) of the road base is illustrated. It may be determined if the road base for application has a strength above a predetermined threshold at 310. If the answer is no (e.g., the road base is sand), the method may include combining an SPI and secondary stabilizers with water (H20) to create a 6.2% SPI material binder, as depicted in this example at 312. The 6.2% solution may be achieved, for example, by combining 9.9 g of SPI and 150.9 g of H20. Thus, the SPI based material binder may be combined with the road base at 314. In one example, 22.4 g of the 6.2% SPI material binder may be combined with 100.7 g of sand, dirt, and gravel to create a mixture containing 22.2% of the 6.2% SPI material binder by weight. Thus, in one example, one gallon of the mixture may contain 247.5 g of SPI. It may be appreciated that the soy-based material binder may include SPI in the range of 1% to 100%.

If the answer is yes at 310 (e.g., the road base is hard gravel), the method may include combining an SPI and secondary stabilizers with water (H20) to create a 5.0% SPI material binder, as depicted in this example at 316. This may involve diluting a 6.2% SPI material binder, in one example. Thus, the 5.0% SPI material binder may be combined with the road base at 318. As one example, 10.1 g of 5.0% SPI material binder may be combined with 100.1 g of sand, dirt, and/or gravel to create a mixture. In another example, a low concentration soy-based material binder, such as a 5.0% SPI material binder may be used as a dust palliative. It may be appreciated that the soy-based material binder may include SPI in the range of 1% to 100%.

Thus, it may be appreciated that as the strength of the road base decreases, the concentration of soy protein isolate in the soy-based material binder may increase. Further, as the strength of the road base increases, the concentration of soy protein isolate in the soy-based material binder may be decreased.

In other embodiments, the soy-based material binder, such as soy protein isolate, defatted soy, etc., alone or in combination with other additives, may be applied to the surface of the soil in a solid form, such as in a flake form.

Figure 4:
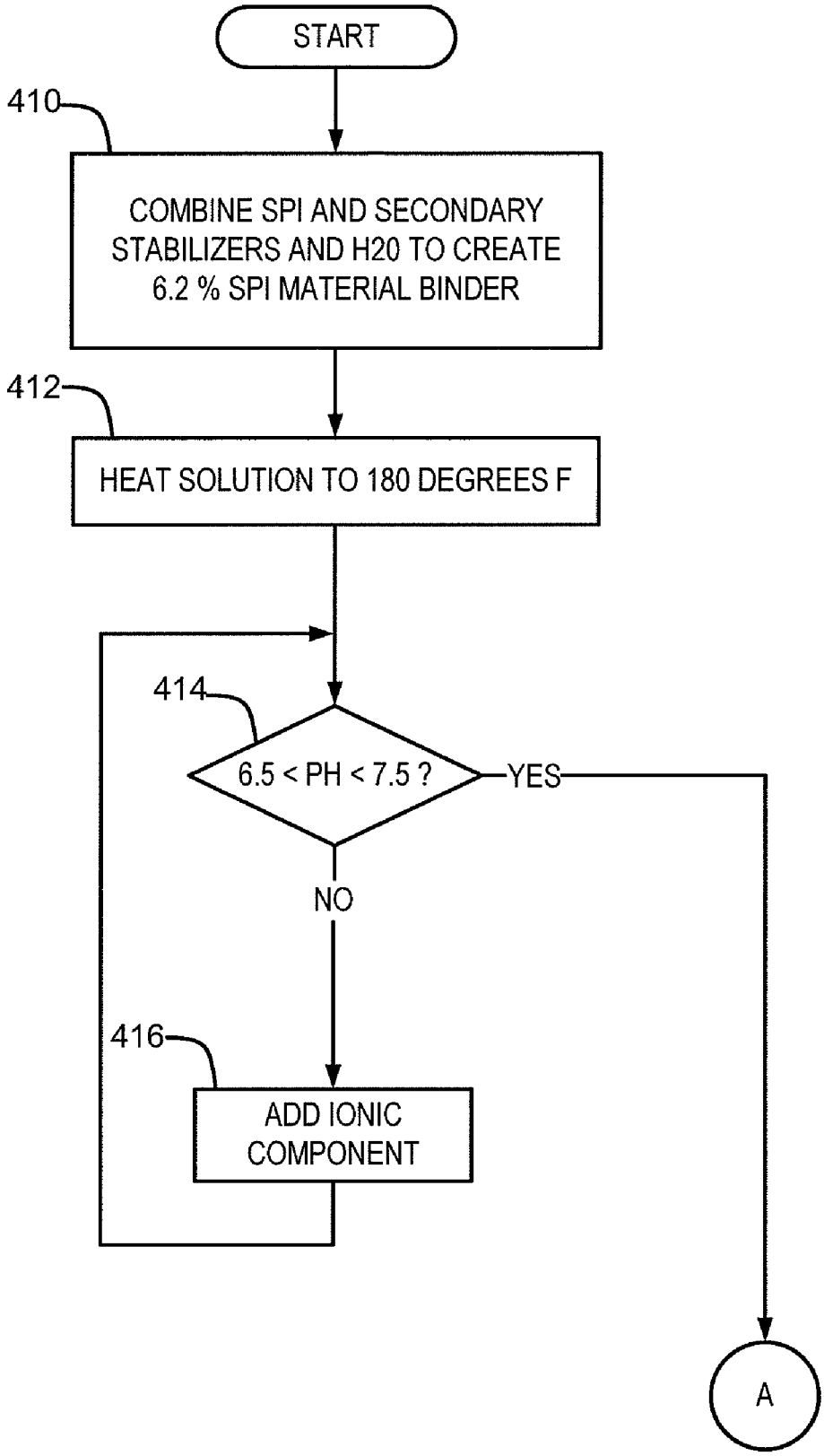
FIGS. 4-5 show example method flowcharts for preparing a soy-based material binder.

To create a mixture including the soy-based material binder, ready for use in a roadbed, an example method flowchart for preparing the soy-based material binder is shown in FIG. 4. At 410, an SPI may be combined with secondary stabilizers and H20 to create a 6.2% SPI material binder, as described above. The method may further include heating the solution to a predetermined value, such as 180 degrees Fahrenheit (F) as depicted in this example at 412, to thereby form an improved soy-based material binder. Further still, the pH of the solution may be monitored, such that at 414 it is determined if the pH of the solution is within a predetermined range of pH values. For example, the range may be pH=6.5-7.5. If the pH of the solution is not within the predetermined range, an ionic component may be added to the solution 416. For example, if the pH is below 6.5 an anionic surfactant may be added to the solution. Alternately, if the pH is above 7.5, a cationic surfactant may be added to the solution. In another example, a non-ionic component may be added to the solution. The ionic and non-ionic components may include cationic, anionic, and non-ionic surfactants, in some embodiments. Thus, the method may further include denaturing by acid or alkali pH modification. Further still, the soy-based material binder may be denatured by the addition of an amino containing compound. From here, the routine proceeds to A, continued at FIG. 6 or FIG. 7, wherein the soy-based material binder may be combined with the road base, for example.

Figure 5:
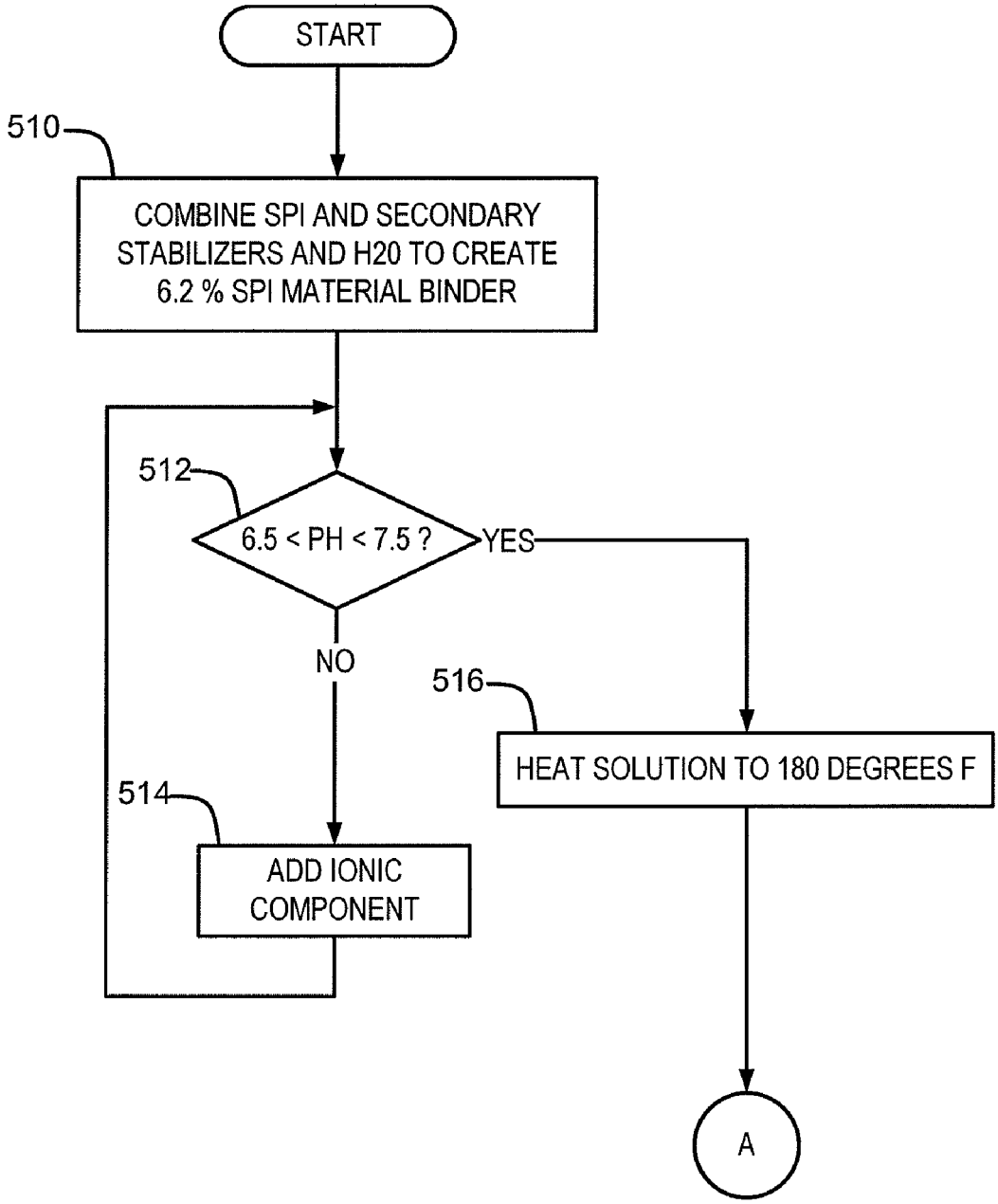

Another example method flowchart for preparing the soy-based material binder ready for use in a road base is shown in FIG. 5. In this example, the solution is created at 510 and the pH is monitored at 512. This example method differs from that of the example method described with respect to FIG. 3 in that the pH of the solution is monitored and altered by addition of ionic components 514 prior to heating of the solution at 516. The steps of FIG. 5 are otherwise the same as in FIG. 4, thus the reader is referred to FIG. 4 for a detailed description.

In other example methods, the soy-based material binder may or may not be heated. Further, with respect to FIGS. 4-5, in some embodiments, the pH of the soy-based material binder may not be monitored. Further still, the pH of the soy-based material binder may not be controlled by addition of ionic and non-ionic components.

Figure 6:
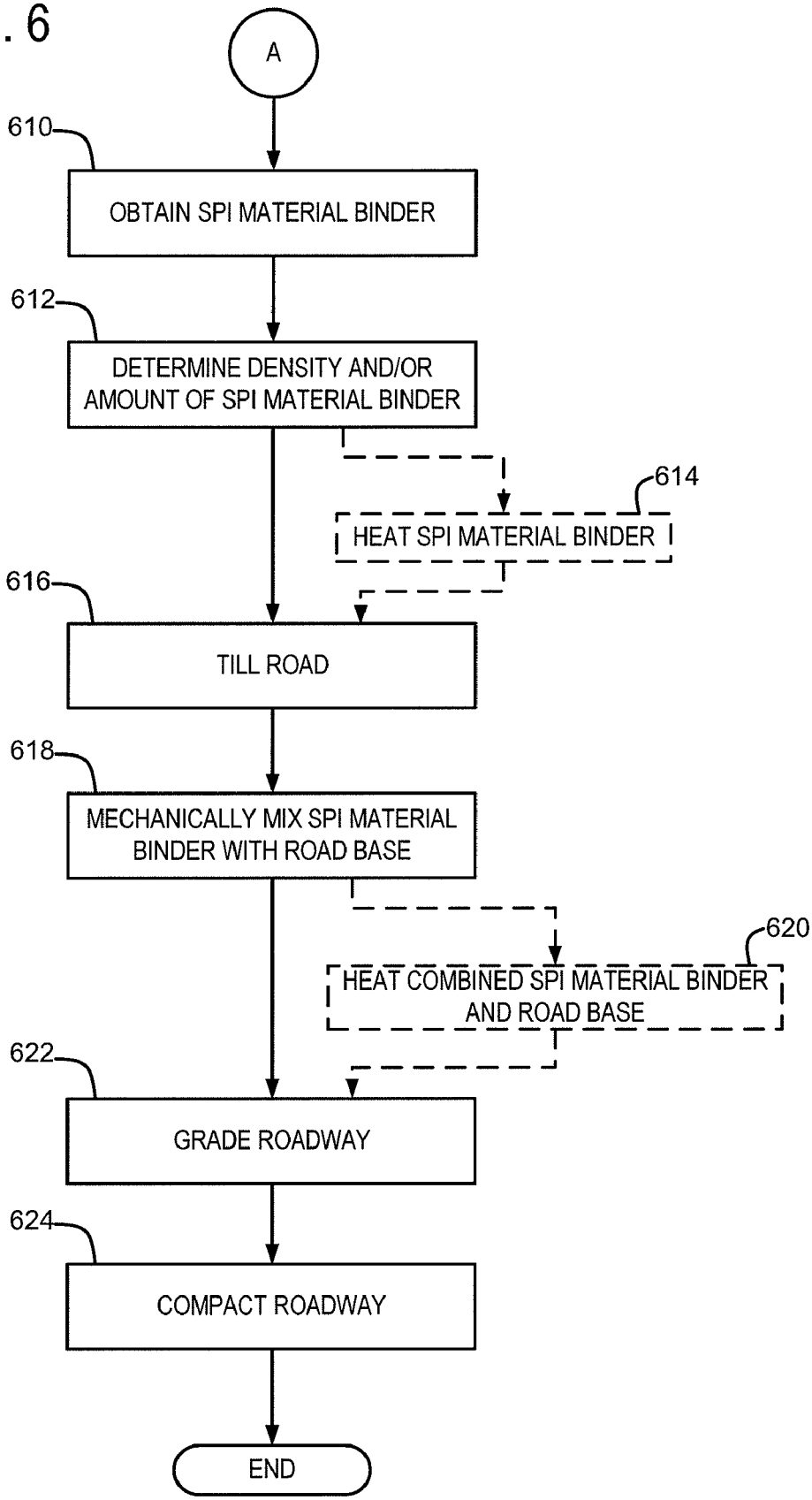
FIGS. 6-7 show example method flowcharts for applying a soy-based material binder to a roadway.
Figure 7:
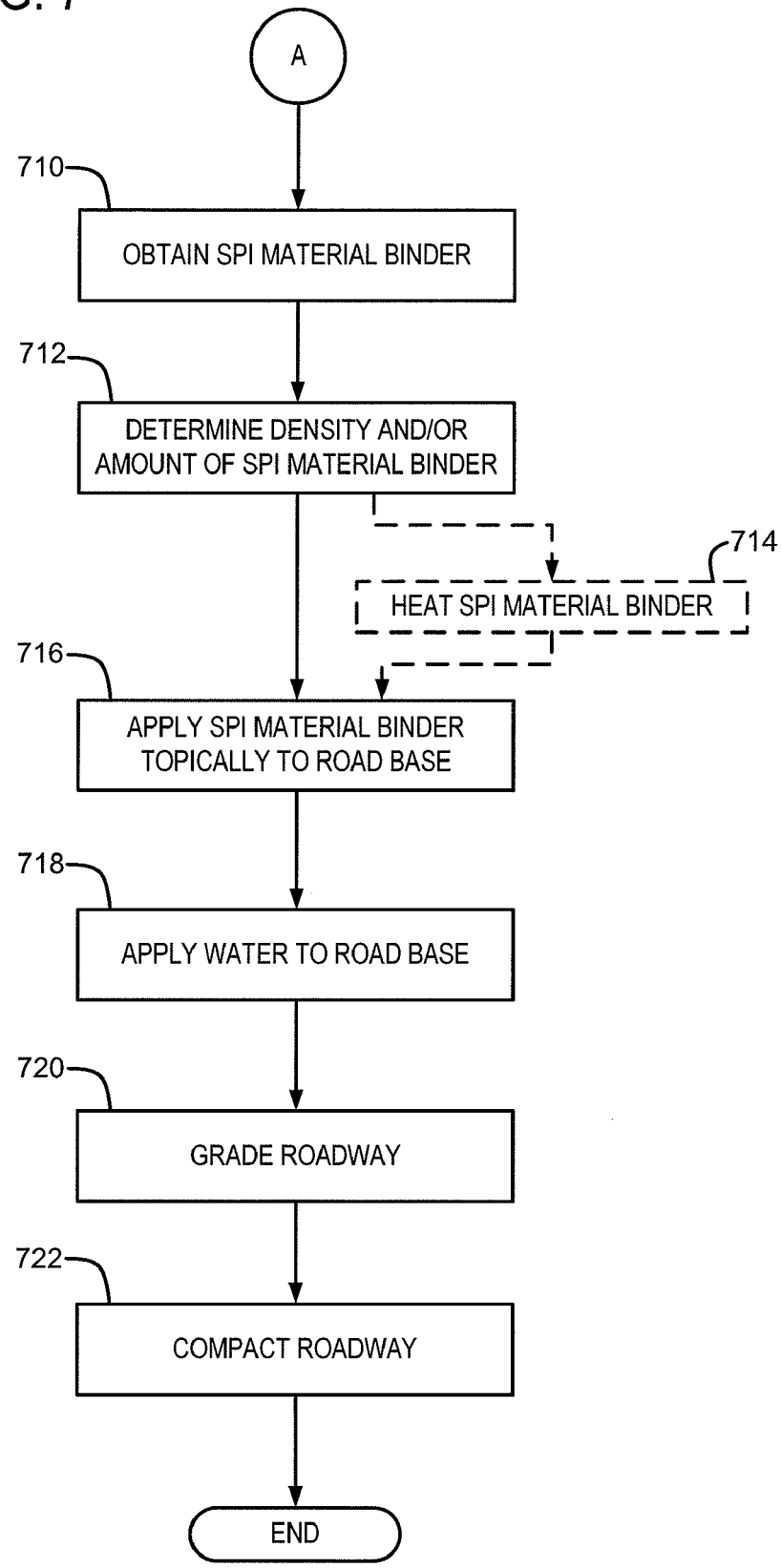

Soy-based material binder may be mixed and applied to a road base in a variety of ways. As noted above, a durable, stabilized road base may be obtained using a process that uses the existing roadbed soils. Exemplary method flowcharts are shown in FIGS. 6-7. It may be appreciated that the soy-based material binder may be heated, such as to 180-degrees F., and then applied topically to a road/soil surface or may be mechanically mixed in with the soil or surface aggregate, as described below. In another embodiment, the soy-based material binder may be applied either topically or mechanically mixed prior to the heating step.

Referring now to FIG. 6, a soy-based material binder, as a solution, in a dry form, or as a mixture with sand, dirt, and/or gravel, for example, is obtained at 610. At 612, a density of a soy-based material binder and/or mixture including soy-based material binder and sand, dirt and/or gravel is determined. Also at 612, an amount of said mixture is determined. As an example, the amount of the mixture may depend on the depth of the road base. Optionally at 614, the solution may be heated. In this example, the road may be tilled to a depth of approximately 4-6 inches at 616 and thus the soy-based material binder may be mixed with the road base 618. At 620, the mixture may be optionally heated, such as to 180 degrees F. The process may continue with grading of the roadway 622 and roller compacting the roadway 624.

Referring now to FIG. 7, the flowchart shows an example method wherein the soy-based material binder is applied topically. A soy-based material binder, as a solution, in a dry form, or as a mixture with sand, dirt, and/or gravel, for example, is obtained at 710. At 712, a density and amount of soy-based material binder is determined, for example, based on the area of desired application. The soy-based material binder may be optionally heated 714, such as to 180 degrees F., and then applied topically at 716. The soy-based material binder, in this example, may be sprayed on the roadway or otherwise topically applied. In this example, a solvent, such as water, may be applied to the roadway to set up the binding process at 718. It may be appreciated that water may not be applied in other embodiments. In one example, the process may continue with grading of the roadway 720 and roller compacting the roadway 722.

An exemplary experiment to determine the density of sand, dirt, and gravel including a soy-based material binder in a quantity of water was conducted. As an example, 318.7 cubic centimeters of H20 was combined with 476.1 g of sand, dirt, and gravel, including a soy-based material binder, such that the density was 1.49 g/cubic centimeter. Subsequent unit conversion examples were conducted to determine that 380 lbs of the sand, dirt, and gravel including a soy-based material binder may be used for a cubic yard with a depth of 4 inches. Thus, one embodiment of the soy-based material binder may include creating 1.25 gallons of a 4:1 EARTHBIND® 100 mixture, such as that of mixture G described above including 0.25 gallons of concentrated EARTHBIND® 100 and 1 gallon of 6.2% SPI material binder for 1 cubic yard with a depth of 4 inches. In one example, 1 cubic yard with a depth of 4 inches may include 380 lbs of soil. Thus, 0.00329 gallons of the 4:1 EARTHBIND® 100 mixture may be used for 1 lb of soil.

Depending on the application and the soil material, various tilling depths may be used, such as 1-3 inches, 0.5-5 inches, 5-10 inches, etc. Further, various blends of soy-based material binder may be introduced such as 1-5%, 5-50%, 20-30%, 10-40%, 25-50%, 35-45%, etc. By varying the amount of soy-based material binder, water and tilled soil and other additives (fly ash, bottom ash, lignin, surfactants, etc.) the strength of the mixture and the mixed composition may be tailored to the specific needs of the roadway.

Further still, it should be appreciated that the amount of SPI, or variant thereof (soy protein concentration, defatted soy, etc.) in the soy-based material binder described in the present application may be varied between 1-100% depending on the application and other factors, including the type of road base or road surface material that the product is to be bonded. Moreover, the amount and concentration of SPI may further be based on the strength of a road base, the moisture content of the road base, or the specific type of road base (e.g. sand, dirt, gravel). Further, the amount and concentration of SPI may be varied depending on the type of road surface. For example, for a hard gravel surface, a reduced amount of binder may be used, while on a sand surface, a more concentrated solution may be used.

For illustrative purposes, in some embodiments, the SPI may be mixed in water in a 6.2% solution or 5.0% solution by weight. As described above, such weight percentages are provided for illustrative purposes only and are not intended to be limiting in any sense. Thus, it may be appreciated that one or more protein isolates or variants thereof may comprise the soy-based material binder alone.

The soy-based material binder and mixture compositions herein described may be used for a variety of applications other than road base stabilization and dust abatement. For example, the composition further may be applied to bare soil surfaces to control erosion and aid in vegetation establishment. For example, the composition may be added to a hydroseeding mix as a seed tackifier. Hydroseeding is a planting process that includes application of a mixture to a soil surface. The hydroseeding mix may include a mix of seed, fertilizer, tackifier, and a fiber medium, such as a cellulose fiber or wood fiber. Once combined, the hydroseeding mix may be applied to a soil surface. For example, the mix may be sprayed onto the surface to form a blanket or mat that protects and stimulates the seeds to begin growing.

Newly planted seeds are vulnerable to wind and rain. The present composition functions as a tackifier in the hydroseeding mix by preventing erosion of the soil surface. The composition further prevents the seeds within the hydroseeding mix from being washed away in a heavy rain. The present composition further functions to minimize subsurface water loss once the hydroseeding mix is applied. Specifically, the composition aids in retaining moisture within the soil and further protects the soil surface from winds, which may dry the soil surface.

In some embodiments, the mixtures of the soy-based material binder also may effectively aid in seed growth. For example, application of the soy-based material binder in a mixture with lignin may, in addition to providing an erosion protected surface, may also operate to darken the soil surface, thereby causing the soil surface to absorb more radiant energy. The absorption of more radiant energy within the soil may result in an increased soil temperature, which may accelerate seed germination.

In addition, the soy-based mixture may be used to generate pellets, including animal and feed pellets, as well as wood or fuel pellets. The binder may bind the feed product or wood product to form pellets. The pellets may be of a select hardness to maintain form regardless of environmental conditions, storage conditions, etc.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring, nor excluding, two or more such elements.

Inventions embodied in various combinations and subcombinations of features, functions, elements, and/or properties may be claimed in a related application. Such claims, whether they are directed to a different invention or directed to the same invention, whether different, broader, narrower or equal in scope to any original claims, are also regarded as included within the subject matter of the inventions of the present disclosure.

The invention claimed is:

1. A method for increasing road stabilization with a soy-based material binder, the method comprising:

determining road base attributes of the road base for application;

creating a soy-based material binder comprising of a soy protein isolate with a concentration in the range of 1 to 20% of soy protein isolate based on road base attributes;

determining an amount of soy-based material binder for a volume of application based on the concentration of soy protein isolate in the soy-based material binder and the road base attributes; and combining the soy-based material binder and the road base wherein the resultant mixture includes soy-based material binder in a range of 0.0001-5 gallons per pound of road base.

2. The method of claim 1 wherein the soy protein isolate is one or more of soy protein concentrate, defatted soy, full fat soy flour, low fat soy flour, high fat soy flour, lecithated soy flour, rapeseed protein isolate, fava bean protein concentrate, and fava bean protein isolate.

3. The method of claim 1 wherein the soy-based material binder further comprises a secondary stabilizer including one or more of a coal combustion product, a resin, a lignin, a surfactant, a calcium chloride, a magnesium chloride, and a sodium chloride.

4. The method of claim 3 wherein the coal combustion product includes one or more of fly ash and bottom ash.

5. The method of claim 3 wherein the lignin includes one or more of calcium lignosulfonate, sodium lignosulfonate, and ammonium lignosulfonate.

6. The method of claim 1 wherein the surfactant includes one or more of a cationic surfactant, anionic surfactant, and non-ionic surfactant.

7. The method of claim 1 wherein the road base includes one or more of a soil, sand, dirt, and gravel.

8. The method of claim 1 wherein road base attributes include hardness, shear strength, dirt content, gravel content, and sand content.

9. The method of claim 1 wherein, for low strength road bases, a high concentration of soy protein isolate is used in the soy-based material binder; further wherein for high strength road bases, a low concentration of soy protein isolate is used in the soy-based material binder.

10. The method of claim 1 further comprising heating one or more of the soy-based material binder and road base to a predetermined value in the range of 50 to 300 degrees Fahrenheit.

11. The method of claim 1 further comprising denaturing the soy-based material binder by acid or alkali pH modification using one or more of cationic surfactant, non-ionic surfactant, anionic surfactant, and an amino containing compound and monitoring the pH of the soy-based material binder wherein the composition of the soy-based material binder is altered by addition of one or more ionic components to obtain a predetermined pH value in the range of 6.5-7.5 if the pH is below a first predetermined threshold or above a second predetermined threshold.

12. The method of claim 1 wherein water is applied to the road base after application of the soy-based material binder.

13. A road base including a soy-based material binder, the road base comprising:

a soy protein isolate;

one or more of a secondary stabilizer, wherein the secondary stabilizer is a coal combustion product, a resin, a lignin, or a surfactant or combinations thereof wherein the soy protein isolate is combined with one or more secondary stabilizers to form a soy-based material binder with a concentration of soy protein isolate in the range of 1-20% of the weight of the soy-based material binder; and a road base including one or more of a soil, sand, dirt and gravel, wherein the road base is combined with the soy-based material binder to form a combination wherein the combination comprises the soy-based material binder in a range of 0.0001-5 gallons per pound of road base.

14. The road base of claim 13 wherein the soy protein isolate is one or more of soy protein concentrate, defatted soy, full fat soy flour, low fat soy flour, high fat soy flour, lecithated soy flour, rapeseed protein isolate, fava bean protein concentrate, fava bean protein isolate.

15. The road base of claim 13 wherein the secondary stabilizer is one or more of a coal combustion product including one or more of fly ash and bottom ash; a lignin including one or more of a calcium lignosulfonate, a sodium lignosulfonate and an ammonium lignosulfonate; and a surfactant including one or more of a cationic surfactant, an anionic surfactant, and a non-ionic surfactant.

16. The road base of claim 13 wherein the soy-based material binder further comprises one or more of calcium chloride, magnesium chloride, and sodium chloride.

17. The road base of claim 13 wherein the soy-based material binder further comprises a solvent including water in a range of 20-99% of the soy-based material binder by weight.

18. A method for increasing road stabilization with a soy-based material binder, the method comprising:

determining road base attributes of the road base for application;

creating a soy-based material binder comprising a soy protein isolate with a concentration in the range of 1 to 20% of soy protein isolate based on road base attributes;

monitoring the pH level of the soy-based material binder;

heating the soy-based material binder to a predetermined threshold;

determining an amount of soy-based material binder for a volume of application based on the concentration of soy protein isolate in the soy-based material binder and the road base attributes; and combining the soy-based material binder and the road base.

19. The method of claim 18 wherein the road base includes one or more of a soil, sand, dirt, and gravel.

20. The method of claim 18 wherein road base attributes include hardness, strength, dirt content, gravel content, and sand content and wherein for low strength road bases, a high concentration of soy protein isolate is used in the soy-based material binder; further wherein for high strength road bases, a low concentration of soy protein isolate is used in the soy-based material binder.

* * * * *